US011820032B2

(12) United States Patent
Ntavos et al.

(10) Patent No.: US 11,820,032 B2
(45) Date of Patent: Nov. 21, 2023

(54) RAZOR HANDLE, ATTACHMENT ADAPTER, AND RAZOR ASSEMBLY

(71) Applicant: BIC VIOLEX S.A., Anoixi (GR)

(72) Inventors: Vasileios Ntavos, Athens (GR); Ioannis Malliaros, Athens (GR); Anastasios Papageorgiou, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 339 days.

(21) Appl. No.: 17/272,061

(22) PCT Filed: Sep. 12, 2019

(86) PCT No.: PCT/EP2019/074421
§ 371 (c)(1),
(2) Date: Feb. 26, 2021

(87) PCT Pub. No.: WO2020/053360
PCT Pub. Date: Mar. 19, 2020

(65) Prior Publication Data

US 2021/0245376 A1 Aug. 12, 2021

(30) Foreign Application Priority Data

Sep. 14, 2018 (EP) ..... 18194642

(51) Int. Cl.
*B26B 21/22* (2006.01)
*B26B 21/52* (2006.01)

(52) U.S. Cl.
CPC ..... *B26B 21/225* (2013.01); *B26B 21/521* (2013.01)

(58) Field of Classification Search
None
See application file for complete search history.

(56) References Cited

U.S. PATENT DOCUMENTS 6,434,839 B1 * 8/2002 Lee ..... B26B 21/225 30/527
9,327,415 B1 5/2016 Hovsepian
(Continued)

FOREIGN PATENT DOCUMENTS

CN 104884212 A 9/2015
CN 205129929 U 4/2016
(Continued)

OTHER PUBLICATIONS

International Search Report and Written Opinion in International Application No. PCT/EP2019/074421, dated Dec. 6, 2019 (19 pages).
(Continued)

*Primary Examiner* — Hwei-Siu C Payer
(74) *Attorney, Agent, or Firm* — Bookoff McAndrews, PLLC

(57) ABSTRACT

The application is related to a handle, an adapter, and a razor assembly. The handle comprises a handle body having a distal end with a cavity opening therein; a pusher retained in the cavity and extending outwardly from the cavity; and a retaining element disposed on the distal end of the handle body. The adapter comprises an adapter body configured to connect with the handle, the adapter body having a channel therethrough, the channel being configured to receive a pusher of the handle, the adapter further comprising two arms extending distally from the adapter body, wherein one or more of the distal ends of the arms have a finger that is configured to engage a respective connecting region of a blade assembly. The razor assembly comprises the handle; the adapter; and a blade assembly.

16 Claims, 5 Drawing Sheets

(56) References Cited

U.S. PATENT DOCUMENTS

| | | | | |
|---|---|---|---|---|
| 9,849,599 | B2 | 12/2017 | Gers-Barlag et al. | |
| 2005/0198840 | A1 | 9/2005 | Worrick, III et al. | |
| 2014/0237828 | A1 | 8/2014 | Bucco | |
| 2015/0273708 | A1 | 10/2015 | Haba | |
| 2016/0250764 | A1 | 9/2016 | Hashimoto | |
| 2017/0087732 | A1 | 3/2017 | Metcalf et al. | |
| 2018/0272549 | A1* | 9/2018 | Son | B26B 21/521 |
| 2021/0245376 | A1* | 8/2021 | Ntavos | B26B 21/225 |

FOREIGN PATENT DOCUMENTS

| | | | |
|---|---|---|---|
| CN | 106660219 | A | 5/2017 |
| CN | 107107361 | A | 8/2017 |
| EP | 1201376 | A2 | 5/2002 |
| EP | 3378610 | A1 | 9/2018 |
| WO | 9310947 | A1 | 6/1993 |
| WO | 9405468 | A1 | 3/1994 |
| WO | 9737819 | A2 | 10/1997 |
| WO | 0200401 | A1 | 1/2002 |
| WO | 2017086510 | A1 | 5/2017 |
| WO | 2017174120 | A1 | 10/2017 |
| WO | 2018134104 | A1 | 7/2018 |

OTHER PUBLICATIONS

Chinese Search Report issued in corresponding Chinese application CN112601642A dated May 16, 2022 (2 pages).

* cited by examiner

RAZOR HANDLE, ATTACHMENT ADAPTER, AND RAZOR ASSEMBLY

This application is a National Stage Application of the International Application No. PCT/EP2019/074421, filed on Sep. 12, 2019, now published as WO/2020/053360. This application claims priority to European Patent Application EP18194642.7, filed on 14 Sep. 2018, entitled "RAZOR HANDLE, ATTACHMENT ADAPTER, AND RAZOR ASSEMBLY", the entire contents of which is incorporated herein by reference.

The present description relates to a handle for a razor assembly, an adapter for connecting the handle to a blade assembly, and a razor assembly including the handle and blade assembly.

BACKGROUND ART

During repeated shaving operations, the razor blades become dulled and need to be replaced. For convenience and cost reasons, some consumers prefer razors having interchangeable blade assemblies so that they do not need to dispose of the handle each time the razor blades are dulled. Additionally, it is desirable to provide a means for interchanging the blade assembly without compromising the pivotability of the blade assembly. Therefore, it is desirable to provide a razor assembly having improved capabilities for selectively attaching and detaching a blade assembly while permitting the blade assembly to pivot relative to the handle. Razor blade assemblies that have an interchangeable blade assembly and/or are rotatable about at least one axis are known in the art.

For example, WO 9 737 819 concerns a replaceable shaving cartridge including an interconnect member adapted to be removably and fixedly attached to a handle extension.

US 2016/250764 concerns a razor with a detachable blade cartridge that allows a blade cartridge to be detachably coupled to a holder.

US 2015/273708 A1 concerns a razor having a pivoting mechanism that allows the razor head to pivot.

US 2014/237828 discloses a razor having a pivot sphere upon which the blade cartridge is rotatably mounted.

U.S. Pat. No. 9,849,599 B2 discloses a razor having a ball joint socket and a ball joint head.

SUMMARY

According to aspects of the present disclosure, a handle for a razor assembly is provided. The handle may comprise a handle body having a distal end with a cavity opening therein, a pusher retained in the cavity and extending outwardly from the cavity, and a retaining element disposed on the distal end of the handle body.

Due to the configuration of the handle, a pusher can be used in a razor assembly that can allow a blade assembly to rotate relative to the handle and the retaining element can be used to operatively attach or detach the blade assembly from the handle.

The pusher may present a spherical distal end.

The spherical distal end of the pusher facilitates the relative rotatative movement of the blade assembly and the handle.

The pusher may be configured to engage an engaging surface of a blade assembly.

This configuration allows the pusher to actively engage the blade assembly such that the blade assembly can be aligned with the handle.

The retaining element may be arranged in a window configured to communicate with the cavity, and the pusher may further include an indentation configured to receive the retaining element.

With this configuration, the window permits the retaining element to interface with the pusher and/or an adapter such that the adapter can be removably fixed to the handle.

The handle may further include a resilient element that is configured to urge the pusher away from the handle body. The resilient element may particularly be a spring. The resilient element may be arranged within the cavity.

The resilient element facilitates the pusher aligning the blade assembly with the handle. Additionally, the resilient element transfers a reactive force to the blade assembly so that the blade assembly can be evenly pressed against a user's skin during a shaving operation which may result in an even shave, thus improving the shaving experience of the user. Furthermore, this reactive and even pressure reduces the risk of skin irritation because it reduces or eliminates the necessity of shaving over the same area of skin multiple times.

The resilient element may be disposed in a gap formed on an inner surface of the cavity.

With this configuration, the handle has a compact arrangement.

The handle may further include a holding pin configured to engage a slot formed at the distal end of the handle body.

The holding pin prevents the pusher from being urged out of the handle body.

The handle may further comprise a button that may be configured to be coupled with the holding pin.

The holding pin also operatively connects the button and the pusher such that it permits a user to control the movement of the pusher by manipulating the button.

The retaining element may be configured to operatively secure an adapter onto the handle.

The retaining element securing the adapter to the handle prevents the adapter and/or blade assembly from being dislodged during a shaving operation.

According to aspects of the present disclosure, an adapter for connecting a blade assembly to a handle is provided. The adapter may comprise an adapter body that may be configured to connect with the handle. The adapter body may have a channel therethrough, the channel may be configured to receive a pusher of the handle. The adapter may also have two arms extending distally from the adapter body, where one or more of the distal ends of the arms may have a finger that may be configured to engage a respective connecting region of the blade assembly.

The adapter facilitates the rotational movement of the blade assembly relative to the handle as well as allowing for the selective attachment of the blade assembly to the handle or adapter.

The channel may have a locking portion that may be configured to engage a retaining element of the handle.

The locking portion of the channel selectively secures the adapter and/or the blade assembly to the handle.

The respective fingers of the adapter may be spring fingers.

The spring fingers help secure the adapter to the blade assembly.

According to aspects of the present disclosure, a razor assembly is provided. The razor assembly may comprise the aforementioned handle and adapter, as well as a blade assembly configured to engage with the adapter.

The configuration of this razor assembly provides a blade assembly that is rotatable relative the to handle such that the blade assembly can adapt to the contours of the skin during a shaving operation as well as providing a removable adapter and blade assembly so that a user may replace the blade assembly after the blades have been blunted and need to be replaced.

An interface defined between a distal end of the pusher and an engaging surface of the blade assembly may be a spherical joint thereby allowing rotation of the distal end over the engaging surface.

The spherical joint facilitates the rotational movement of the blade assembly relative to the handle, which permits the blade assembly to adapt to the contours of the skin during a shaving operation. The pusher may be configured to rotate the blade assembly relative to the adapter.

This relative rotation results in an improved shaving experience for the user as it permits the blade assembly to adapt to the contours of the skin during a shaving operation.

The pusher may be configured to align the blade assembly relative to the handle.

The spring transfers a reactive force via the pusher to the blade assembly so that the blade assembly can be evenly pressed against a user's skin during a shaving operation which may result in an even shave, thus improving the shaving experience of the user. Furthermore, this reactive and even pressure reduces the risk of skin irritation because it reduces or eliminates the necessity of shaving over the same area of skin multiple times.

The blade assembly may have one or more connecting regions that may be configured to engage the respective fingers of the adapter.

These connecting regions allow the blade assembly to pivot relative to the adapter and/or handle.

The connecting regions may comprise partially spherical recessed surfaces, more specifically a triangular shape, or combinations thereof.

The spherical shape of the recesses facilitates the rotational or pivotable movement of the blade assembly relative to the adapter and/or handle. Furthermore, the triangular shape of the recesses help control the amount of rotation of the blade assembly relative to the adapter.

A proximal face of the blade assembly may include an engaging surface which may form a partially spherical recess; more specifically the engaging surface may be concentric with the connecting regions.

This configuration facilitates the rotational movement of the blade assembly relative to the handle.

The above summary is not intended to describe each and every implementation of the concept. In particular, selected features of any illustrative embodiment within this disclosure may be incorporated into additional embodiments unless clearly stated to the contrary or otherwise incompatible.

BRIEF DESCRIPTION OF THE DRAWINGS

The disclosure may be more completely understood in consideration of the following detailed description of non-limiting aspects of the disclosure in connection with the accompanying drawings, in which.

Figure 1:
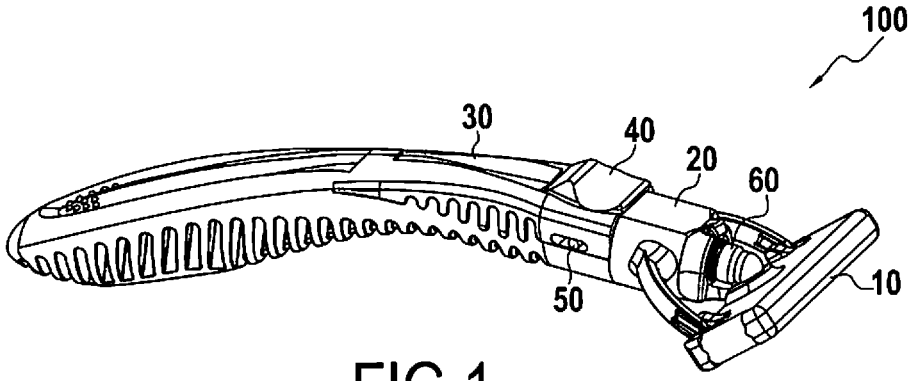
FIG. 1 is a perspective view of an exemplary razor blade assembly according to some embodiments.

While aspects of the disclosure are amenable to various modifications and alternative forms, specifics thereof have been shown by way of example in the drawings and will be described in detail. It should be understood, however, that the intention is not to limit aspects of the disclosure to the particular embodiment described. On the contrary, the intention of this disclosure is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative aspects and are not intended to limit the scope of the present disclosure. The illustrative aspects depicted are intended only as exemplary.

Figure 2:
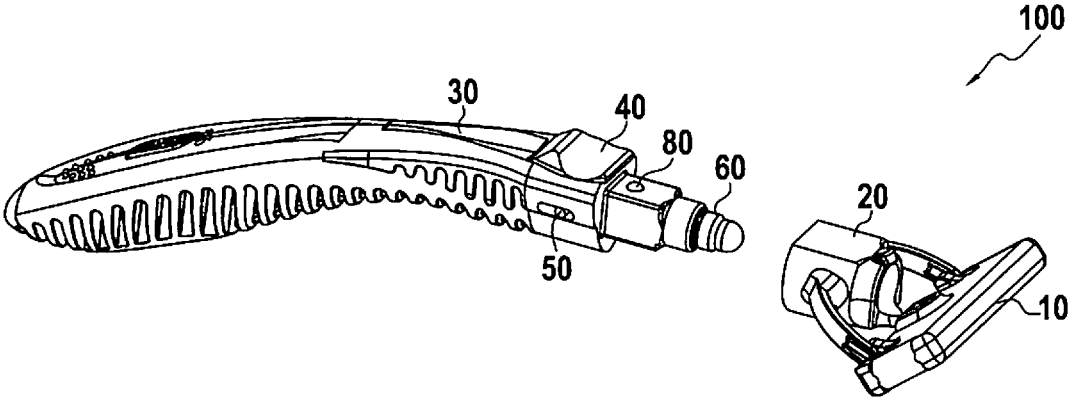
FIG. 2 is a perspective view of the shaving blade assembly of FIG. 1 with the adapter and blade assembly detached from the handle.

FIGS. 1-2 depict a razor assembly 100 that may include a blade assembly 10, an adapter 20, and a handle 30. The blade assembly and adapter 20 may be removably attached to the handle 30. The razor assembly 100 may be specifically adapted for shaving facial, head, and/or body hair.

Figure 3:
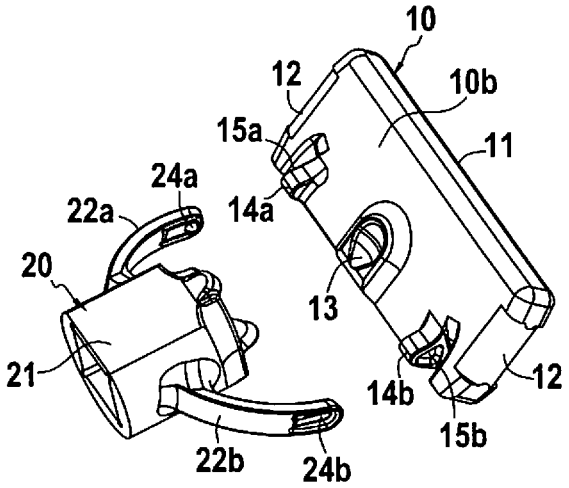
FIG. 3 is a exploded view of the adapter and blade assembly of FIG. 1.

As can be seen in FIG. 3, the blade assembly 10 may be formed in a prism shape having, e.g., a rectangular base. In alternatives, the blade assembly 10 may have any other prism shape, for example an oval shape. The blade assembly 10 may also include a cap 11 and a pair of retainers 12 adapted to retain the position of at least one blade (not shown) within the blade assembly 10.

The blade assembly 10 may include a plurality of blades 30, however, it is contemplated that the blade assembly 10 may have any number of blades (e.g., 1 blade, 2 blades, 3 blades, 4 blades, etc.).

On an opposing side or proximal face 10*b* of the blade assembly 10 is an engaging surface 13 that may be configured to be engaged by a pusher 60 of the handle 30. The engaging surface 13 may be formed as a depression on the surface of the blade assembly 10. However, it is envisioned that the engaging surface 13 may have any other suitable shape, for example, it may be formed as a protuberance. The circumference of the engaging surface 13 may be tear-drop shaped. The surface of the engaging surface 13 may be curved. The engaging surface 13 may be a spherical recess.

The blade assembly 10 may further include a pair of flanges 14*a*, 14*b* that are adapted to connect with the adapter 20. The flanges 14*a*, 14*b* may be formed as projections. Each of the flanges 14*a*, 14*b* may further include a connecting region 15*a*, 15*b* where the adapter is configured to connect with the flanges 14*a*, 14*b*. The connecting region 15*a*, 15*b* may be formed as spherical recesses on the lateral surface of the flanges 14*a*, 14*b*, and more specifically, the connection region 15*a*, 15*b* may have a triangular shape to facilitate control of the rotational movement of the blade assembly 10 when connected with the adapter 20.

Also shown in FIG. 3 is the adapter 20. The adapter 20 may have an adapter body 21 having a pair of arms 22*a*, 22*b* that extend distally therefrom. Each of the arms 22*a*, 22*b* may be curved. The arms 22*a*, 22*b*, may be formed to define an arc shape.

Figure 4:
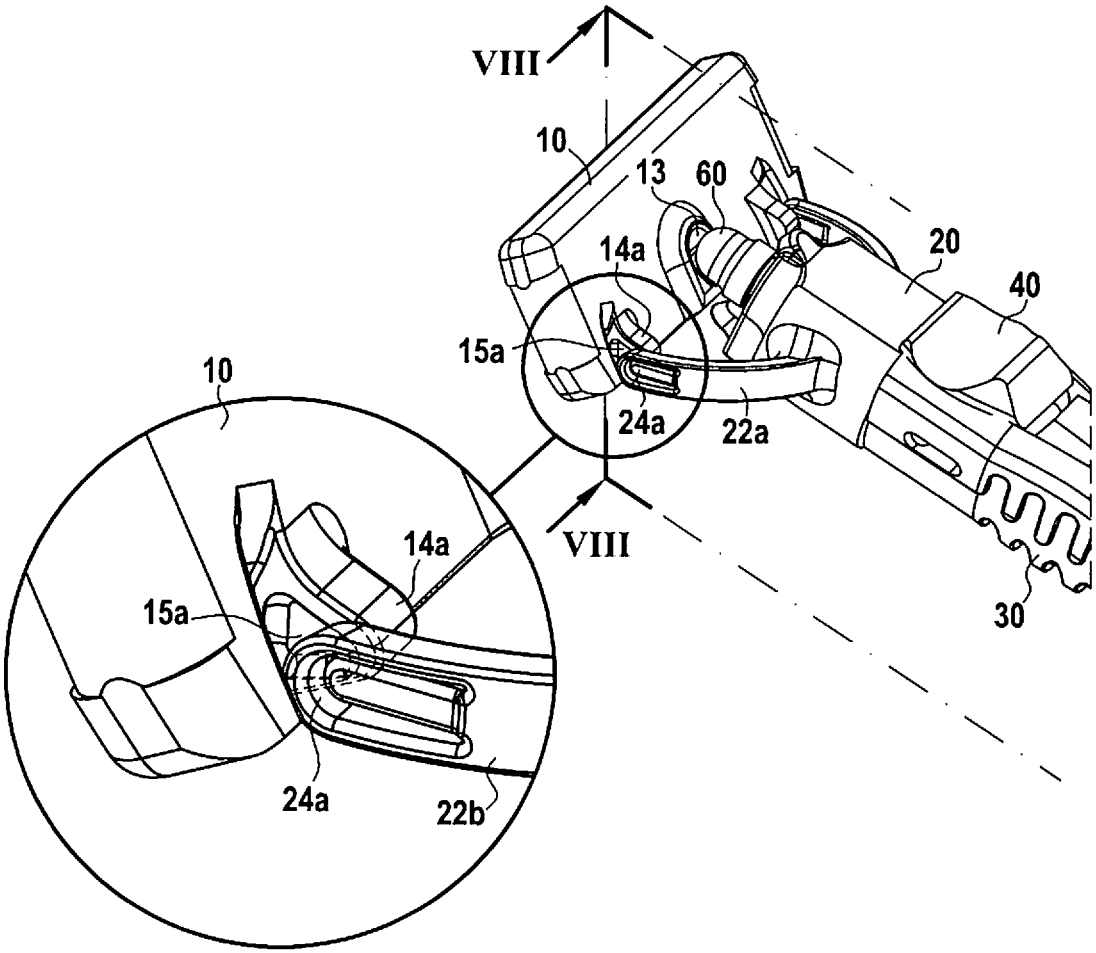
FIG. 4 is a detailed view showing the attachment of the adapter and blade assembly of FIG. 1.

As can be seen in FIGS. 3 and 4, the distal ends of each of the arms 22*a*, 22*b* may include a finger 24*a*, 24*b*, more specifically a spring finger. The spring fingers 24*a*, 24*b* may be configured to connect with a respective flange 14*a*, 14*b* of the blade assembly 10. In particular, the fingers 24*a*, 24*b* may be adapted to snap fit with a respective recess 15*a*, 15*b* in the flanges 14*a*, 14*b*. In operation, the fingers 24*a*, 24*b* may be disposed in a respective vertex of the triangular shaped connection regions 15*a*,15*b* when the blade assembly 10 is in an at rest position. However, when the blade assembly 10 is in a rotated or pivoted position, the respective fingers 24*a*, 24*b* may be disposed in another respective vertex of the triangular shaped connection regions 15*a*, 15*b*.

Figure 5A:
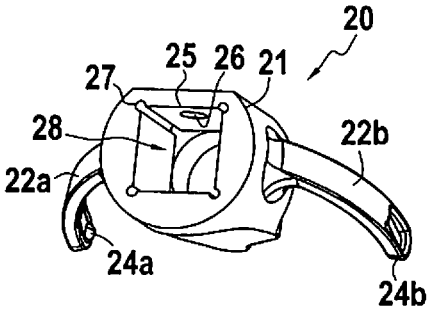
FIG. 5A is a perspective view of the proximal end of the adapter.
Figure 5B:
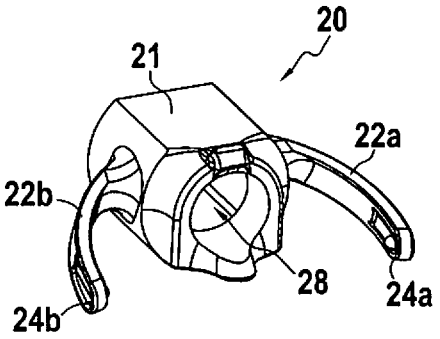
FIG. 5B is a perspective view of the distal end of the adapter.

As shown in FIGS. 5A and 5B, the adapter 20 may include a channel 28 that extends through the adapter body 21 between the arms 22*a*, 22*b*. The channel 28 may be configured to permit at least a portion of the handle 30 to traverse therethrough, in particular the pusher 60.

The interior surface 25 of the channel 28 may include at least one relief 27. The relief 27 may be configured to facilitate connecting the adapter 20 with the handle 30. The relief 27 may extend through the adapter body 21. However, it is also envisioned that the relief 27 may extend through a portion of the adapter body 21.

The interior surface 25 of the channel 28 may further include a locking portion 26. The locking portion 26 may be configured to engage a retaining element 80 of the handle 30. The locking portion 26 may be configured to secure the adapter 20 to the handle 30. The locking portion 26 may be formed as an indentation; however the locking portion may be formed as any other suitable shape, e.g. a square.

Figure 6:
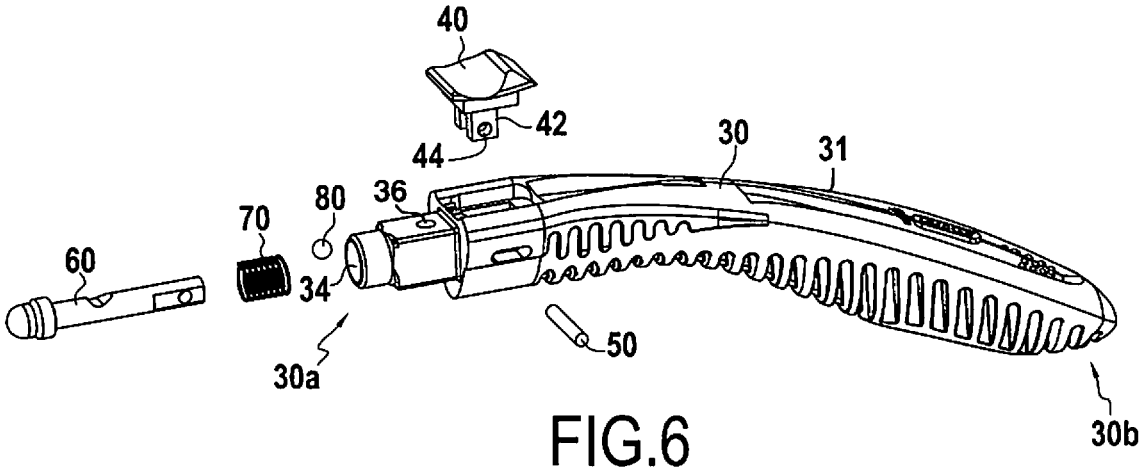
FIG. 6 is an exploded view of the handle of the razor blade assembly of FIG. 1.

As shown in FIG. 6, the razor assembly 100 may further include an elongated handle 30. The handle 30 has a distal end 30*a* and a proximal end 30*b*. The handle 30 may be shaped to adapt to the natural contours of a hand.

The handle 30 may have a handle body 31 and a cavity 34 at the distal end thereof. The handle 30 may further include a button 40, a holding pin 50, a pusher 60, and a resilient element 70.

Additionally, the handle 30 may include a retaining element 80. The retaining element 80 may be selectively engaged with the adapter 20. The retaining element 80 may be adapted to secure the adapter 20 to the handle 30. The retaining element 80 may be configured to be driven by the pusher 60.

Figure 7:
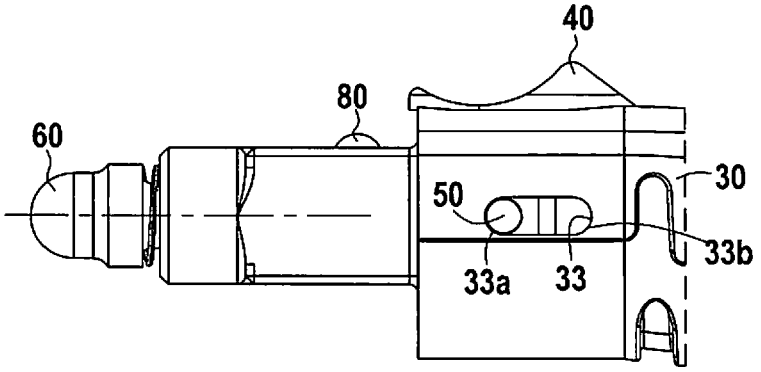
FIG. 7 is a side view of the distal end of the handle of FIG. 2.
Figure 8:
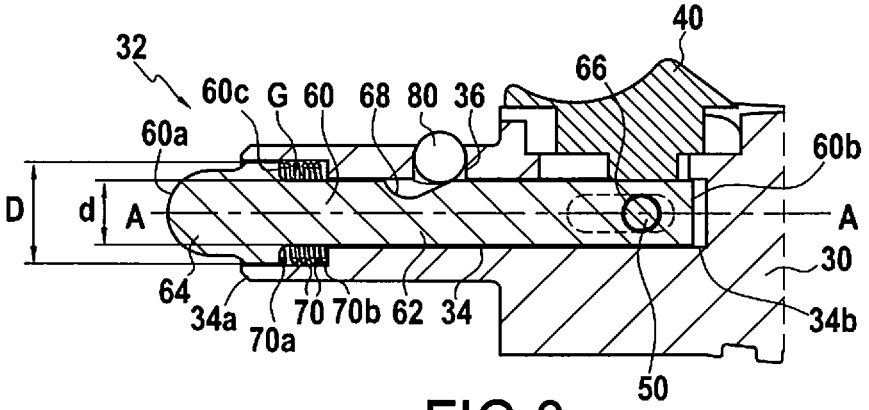
FIG. 8 is a cross-section the distal end of the handle of FIG. 7.

Shown in FIGS. 7 and 8 is a side view and a cross-section of the handle 30 and retaining element 80. As can be seen, button 40 may be disposed on the handle 30 such that it can be manipulated by a user. The button 40 may be connected to and slidable relative to the handle body 31. The button 40 may extend into the cavity 34. The button 40 may have a pair of legs 42 that extend into the cavity 34. Each of the legs 42 may include a through hole 44. Each of the through holes 44 may be configured to receive the holding pin 50 therein.

The holding pin 50 may be configured to link the button 40 with the pusher 60. The holding pin 50 may be configured to move relative to the handle body 31. The handle body 31 may further include a slot 33. The slot 33 may have a distal end 33*a* and a proximal end 33*b* that are configured to stop the holding pin 50 from being displaced from the slot 33. The holding pin 50 may be configured to slide within slot 33 between the distal and proximal ends thereof 33*a*, 33*b*. The holding pin 50 may be formed in any appropriate shape, more specifically a cylinder.

The handle 30 further includes a pusher 60. The pusher 60 may be elongate and have a distal end 60*a* and a proximal end 60*b*. The distal end 60*a* of the pusher 60 may be adapted to engage the engaging surface 13 of the blade assembly 20. The distal end 60*a* of the pusher 60 may be convex. The distal end 60*a* of the pusher 60 may have a spherical shape. The proximal end 60*b* of the pusher 60 may be formed as a shaft. The proximal end 60*b* of the pusher 60 may have a smaller radius than the distal end 60*a* of the pusher 60 such that a wall 60*c* is formed between the distal and proximal ends 60*a*, 60*b*.

The distal end 60*b* of the pusher may also include a through hole 66. The through hole 66 may be configured to receive the holding pin 50.

The pusher 60 may be slidable relative to the handle body 31. The pusher 60 may be configured to move between an extended position and a retracted position. The pusher 60 may be configured to move between the extended and retracted positions by a user manipulating the button 40.

The pusher 60 may also include an indentation 68. The indentation may be configured to receive the retaining element 80.

The handle 30 may further include a resilient element 70. The resilient element 70 may be a coil spring. The resilient element 70 may have a distal end 70*a* and a proximal end 70*b*. The distal end 70*a* of the resilient element may be configured to contact the wall 60*c* formed on the pusher 60. The proximal end 70*b* of the resilient element 70 may be configured to contact the interior surface of the cavity 34 formed in the handle 30. The resilient element 70 may be disposed within a gap G formed between the proximal end 60*b* of the pusher and the interior surface of the cavity 34. The resilient element 70 may be configured to urge the pusher 60 into the extended position.

The handle 30 further includes the retaining element 80. The retaining element 80 may be at least partially disposed within a window 36 formed on the handle body 31. The window 36 may extend from the exterior surface of the handle body 31 to the cavity 34 formed therein. The retaining element 80 may be configured to move relative to the handle body 31. The retaining element 80 may be configured be received into the indentation 68 of the pusher 60. The retaining element 80 may be configured to selectively engage the locking portion 26 of the adapter 20. The retaining element 80 may be formed as a sphere, however any other suitable shape may be used, for example, a cylinder.

Figure 9A:
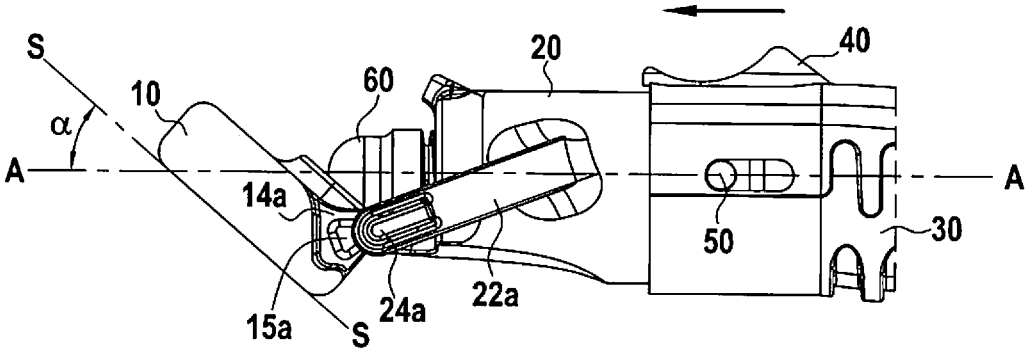
FIGS. 9A and 9B are side and cross-sectional views, respectively, of the razor assembly as the pusher is in an extended position.
Figure 9B:
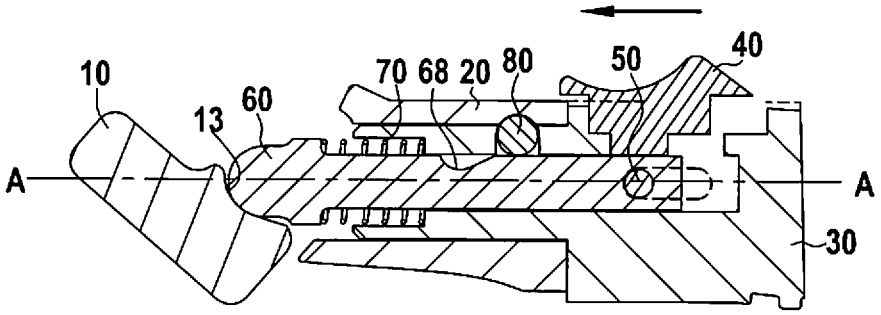
Figure 9C:
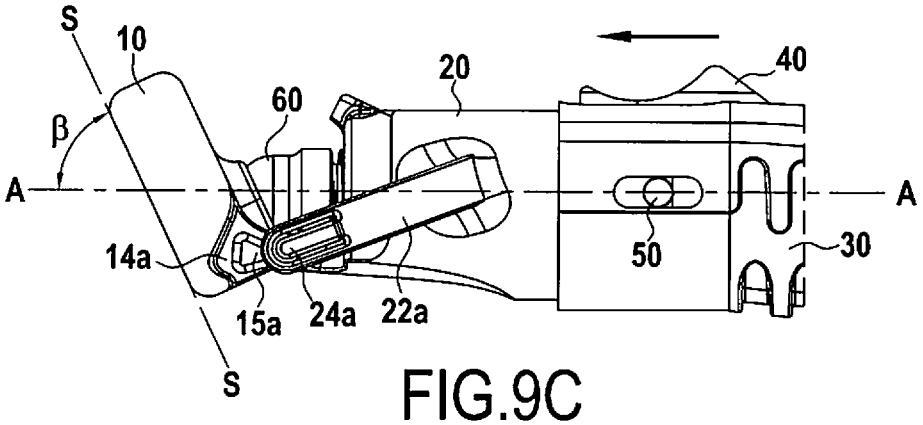
FIG. 9C is a sides view of the razor assembly when the pusher is transitioning between the extended position and a retracted position.

Turning to FIGS. 9A-9C which demonstrate how the handle 30 causes the blade assembly 10 to rotate relative to the handle 30 and how the blade assembly 10 can be selectively attached to the handle 30.

A longitudinal axis A-A is defined as the center axis of the channel 28 of the adapter 20. A shaving plane S-S is defined by a plane at which the shaving is to be performed.

FIG. 9A shows the razor assembly 100 in a rest position. In this position, the pusher 60 is in the extended position and the distal end 60*a* of the pusher 60 is engaging the engaging surface 13 of the blade assembly 10. This engagement aligns the blade assembly 10 with the handle 30. In particular, the pusher 60 may position the shaving plane S-S of the blade assembly 10 to be at an angle α relative to the longitudinal axis A-A. As can be seen, the holding pin 50 is disposed on the distal end 33*a* of the slot 33. This is due to the resilient element 70 urging the distal end 60*a* of the pusher 60 away from the handle body 31. However, the holding pin 50 holds the pusher 60 within the cavity 34 by contacting the distal end 33*a* of the slot 33.

As can be seen in FIG. 9B, which is a cross-section of FIG. 9A, when the pusher 60 is in the extended state, the retaining element 80 is not seated within the indentation 68 of the pusher 60. Additionally, the retaining element 80 is disposed within the locking portion 26 of the adapter 20, thereby securing the adapter 20 to the handle 30.

FIG. 9C shows the razor assembly 100 in a transitional state where the pusher 60 is between the extended and retracted positions. This is further shown by the location of the holding pin 50 within the slot 33. As can be seen, the angle β formed between the longitudinal axis A-A and the shaving plane S-S is smaller than the angle α when the pusher 60 is in the extended position. Also, as can be seen, the blade assembly 10 has pivoted about its connecting regions 13*a*, 13*b*.

Figure 9D:
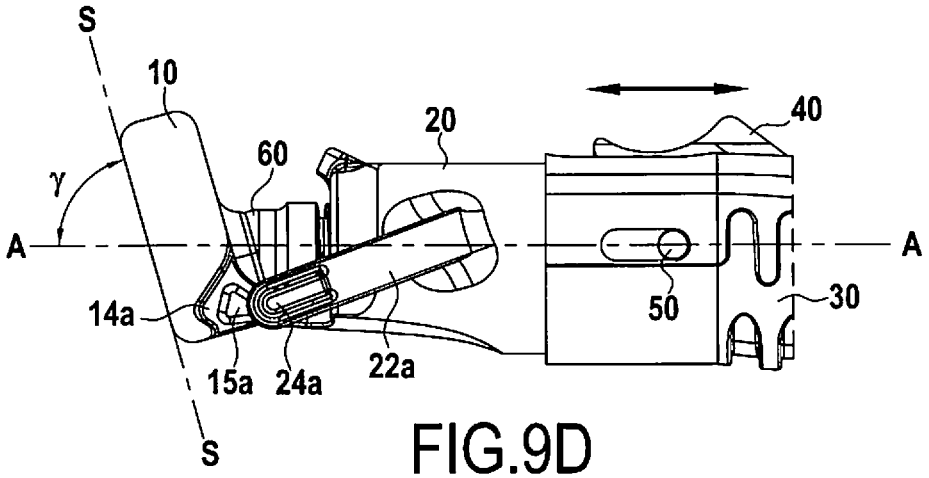
FIGS. 9D and 9E are side and cross-sectional views, respectively, of the razor assembly as the pusher is in the retracted position.
Figure 9E:
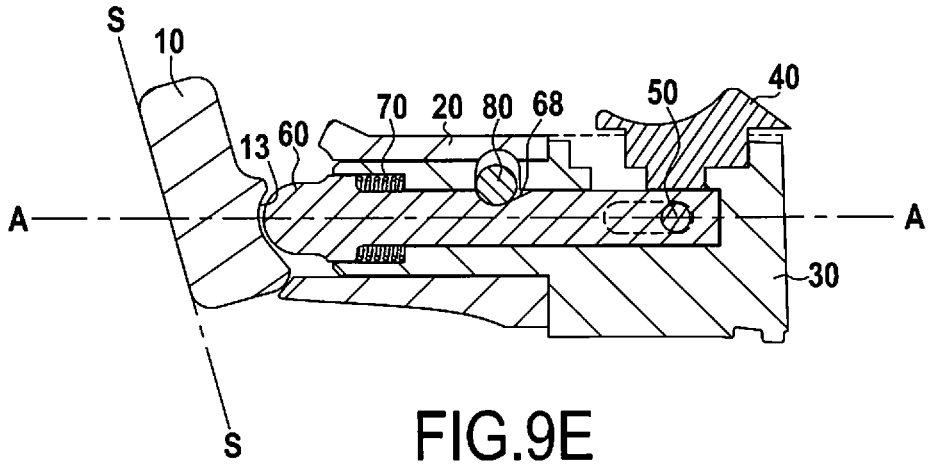

FIGS. 9D and 9E show the razor assembly 100 when a user has manipulated the button 40 to move the pusher 60 into the retracted position. As seen in FIG. 9D, this is further demonstrated by the location of the holding pin 50, which is positioned at the proximal end 33*b* of the slot 33. Furthermore, the blade assembly 100 is further pivoted about its connecting regions and having an angle γ formed between the longitudinal axis A-A and the shaving plane S-S which is smaller than the angle α when the pusher 60 is in the extended position and angle β when the pusher 60 is in a transitional position.

As can be seen in FIG. 9E, which is a cross-section of FIG. 9D, the resilient element 70 is compressed between the wall 60*c* of the pusher 60 and the interior surface of the cavity 34. When the pusher 60 is in the retracted state, the retaining element 80 is seated within the indentation 68 of the pusher 60 and not disposed within the locking portion 26 of the adapter 20, thereby allowing the user to remove the adapter 20 and blade assembly 10 from the handle 30.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A handle for a razor assembly comprising:

a handle body having a distal end with a cavity therein;

a pusher retained in the cavity and extending outwardly from the cavity; and a retaining element disposed at least partially within a window formed on the distal end of the handle body;

wherein the window is configured to communicate with the cavity and the pusher further includes an indentation configured to receive the retaining element.

2. The handle according to claim 1, wherein the pusher presents a spherical distal end.

3. The handle according to claim 1, wherein the pusher is configured to engage an engaging surface of a blade assembly.

4. The handle according to claim 1, further including a resilient element arranged within the cavity, the resilient element being configured to urge the pusher away from the handle body.

5. The handle according to claim 4, wherein the resilient element is disposed in a gap formed on an inner surface of the cavity.

6. The handle according to claim 1, further including a holding pin configured to engage a slot formed at the distal end of the handle body.

7. The handle according to claim 6, further comprising a button configured to be coupled with the holding pin.

8. An adapter for connecting a blade assembly to the handle according to claim 1, the adapter comprising:

an adapter body configured to connect with the handle, the adapter body having a channel therethrough, the channel being configured to receive the pusher of the handle;

the adapter further comprising two arms extending distally from the adapter body, wherein one or more distal ends of the arms have a finger that is configured to engage a respective connecting region of the blade assembly.

9. The adapter according to claim 8, wherein the channel has a locking portion that is configured to engage the retaining element of the handle.

10. The adapter according to claim 8, wherein the fingers are spring fingers.

11. The handle according to claim 1, wherein the window extends from an exterior surface of the handle body to the cavity formed therein.

12. A razor assembly comprising the handle of claim 1 and a blade assembly coupled to the handle.

13. A razor assembly comprising:

a handle having a handle body having a distal end with a cavity therein;

the handle having a pusher retained in the cavity and extending outwardly from the cavity; and a retaining element disposed at least partially within a window formed on the distal end of the handle body;

an adapter having an adapter body having a channel therethrough, the channel being configured to receive the pusher of the handle;

a blade assembly configured to engage with the adapter;

the adapter further comprising two arms extending distally from the adapter body, wherein one or more distal ends of the arms have a finger that is configured to engage a respective connecting region of the blade assembly;

the adapter configured to connect with the handle; and wherein the channel has a locking portion that is configured to engage the retaining element of the handle.

14. The razor assembly according to claim 13, wherein an interface defined between a distal end of the pusher and an engaging surface of the blade assembly is a spherical joint thereby allowing rotation of the distal end over the engaging surface.

15. The razor assembly according to claim 13, wherein the connecting regions of the blade assembly comprises partially spherical recessed surfaces.

16. A handle for a razor assembly comprising:

a handle body having a distal end with a cavity therein;

a pusher retained in the cavity and extending outwardly from the cavity; and a retaining element disposed at least partially within a window formed on the distal end of the handle body;

a holding pin configured to engage a slot formed at the distal end of the handle body; and a button configured to be coupled with the holding pin.

* * * * *